US006432603B1

(12) United States Patent
Kimura et al.

(10) Patent No.: US 6,432,603 B1
(45) **Date of Patent: *Aug. 13, 2002**

(54) PROCESS FOR PRODUCING ELECTROPHOTOGRAPHIC PHOTOSENSITIVE MEMBER

(75) Inventors: Tomohiro Kimura, Kawasaki; Yoichi Kawamorita, Chigasaki; Koichi Suzuki, Yokohama; Hideaki Nagasaka, Shizuoka-ken; Shigemori Tanaka, Susono; Yoshihiko Hyosu, Shizuoka-ken, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/447,230

(22) Filed: Nov. 23, 1999

(30) Foreign Application Priority Data

| | | |
|---|---|---|
| Nov. 27, 1998 | (JP) | 10-337614 |
| May 31, 1999 | (JP) | 11-151618 |
| May 31, 1999 | (JP) | 11-151619 |

(51) Int. Cl.[7] ..... G03G 5/10; G03G 5/14

(52) U.S. Cl. ..... 430/131; 430/65; 430/69; 430/127

(58) Field of Search ..... 430/127, 131, 430/60, 64, 65, 69; 148/275, 247

(56) References Cited

U.S. PATENT DOCUMENTS

| | | | | |
|---|---|---|---|---|
| 4,422,886 A | * | 12/1983 | Das et al. | 148/247 |
| 4,936,948 A | | 6/1990 | Ohki et al. | 216/52 |
| 5,080,993 A | | 1/1992 | Maruta et al. | 430/128 |
| 5,332,643 A | | 7/1994 | Harada et al. | 430/127 |
| 5,429,715 A | * | 7/1995 | Thomas et al. | 216/103 |
| 5,868,872 A | | 2/1999 | Karmaschek et al. | 148/247 |

FOREIGN PATENT DOCUMENTS

| | | | |
|---|---|---|---|
| DE | 3930044 | | 3/1990 |
| DE | 3932093 | | 3/1990 |
| DE | 4412138 | | 10/1995 |
| EP | 0919877 | * | 6/1999 |
| JP | 54-012733 | | 1/1979 |
| JP | 57-029051 | | 2/1982 |
| JP | 58-014841 | | 1/1983 |
| JP | 01-029852 | | 1/1989 |
| JP | 01-086153 | | 3/1989 |
| JP | 01-123246 | | 5/1989 |
| JP | 02-007070 | | 1/1990 |
| JP | 05-034964 | | 2/1993 |
| JP | 06-035216 | | 2/1994 |
| JP | 07-043922 | | 2/1995 |
| JP | 07-15589 | | 7/1995 |
| JP | 08-001510 | | 1/1996 |
| JP | 09-179322 | | 7/1997 |
| JP | 2668985 | | 10/1997 |

OTHER PUBLICATIONS

Japio Abstract AN 182–062056 of JP 57062056, Jul. 1982.*

Patent & Trademark English–Language Transition of JP 57–62056 (Pub Apr. 1982).*

Neufeldt, V. et al., ed. *Webster's New World Dictionary*, Third College Edition, Simon & Schuster, NY (1988), p. 524.*

* cited by examiner

*Primary Examiner*—Janis L. Dote
(74) *Attorney, Agent, or Firm*—Fitzpatrick, Cella, Harper & Scinto

(57) ABSTRACT

A process for producing an electrophotographic photosensitive member has at least one of the following steps a) and b) and the following steps c) and d) of; a) etching an aluminum substrate with at least one of an acid and an alkali; b) abrading an aluminum substrate with an abrasive dispersion containing 5% by volume or more of an abrasive having a 50% diameter of from 5 $\mu$m to 60 $\mu$m as measured in cumulative percentage; c) subjecting the aluminum substrate having been processed by at least one of the steps a) and b), to chemical conversion with an aqueous acid solution containing a salt of titanium or a salt of zirconium; and d) forming a photosensitive layer on the aluminum substrate having been subjected to the chemical conversion.

13 Claims, 3 Drawing Sheets

PROCESS FOR PRODUCING ELECTROPHOTOGRAPHIC PHOTOSENSITIVE MEMBER

BACKGROUND OF THE INVENTION

1. Field of the Invention

This invention relates to a process for producing an electrophotographic photosensitive member.

2. Related Background Art

Electrophotographic photosensitive members are constituted basically of a photosensitive layer on which a latent image is formed by electrostatic charging and exposure to light and a substrate on which the photosensitive layer is provided.

Meanwhile, electrophotographic photosensitive members are required to have sensitivities, electric properties and optical characteristics in accordance with electrophotographic processes applied.

They are also required to have an environmental stability in any environment of from low temperature/low humidity to high temperature/high humidity which is high enough to well exhibit their performances.

Faulty images are exemplified typically by white lines, black spots in white background areas, white spots in black background areas, background fog in white background areas, and also interference fringes caused by factors such as surface shape of substrates and uneven layer thickness of photosensitive members in the case of apparatus such as digital copying machines and laser beam printers in which exposure is effected using a light source having a single wavelength. Accordingly, in the manufacture of photosensitive members, some countermeasures must be taken previously so that these faulty images do not occur.

As a factor having a great influence when such faulty images occur, there can be given the surface state of a substrate.

Substrates having not been treated at all after molding usually do not necessarily have any surface state as it is which is most suited for photosensitive members. Hence, problems caused by the surface state may occur in many instances.

To solve such problems, conventionally, as disclosed in, e.g., Japanese Patent Applications Laid-open No. 1-123246 and No. 64-86153, the photosensitive layer is formed after the surface of an aluminum substrate has been ground on a lathe. In particular, in the case of photosensitive members for digital systems, it is proposed to grind the surface of a substrate to have an appropriate unevenness so as to prevent interference fringes.

When, however, the aluminum substrate is ground, continuous work marks may remain in the peripheral direction. Hence, streaky faulty images may appear in halftone images, or, in particular, moires tend to occur because of the relationship between digital images and laser scanning lines.

Japanese Patent Applications Laid-open No. 7-43922 and No. 8-1510 disclose roller burnishing made on the periphery of a substrate. This method can provide a surface which is uneven without regularity. However, since a hard grindstone is rotated at a high speed to grind the substrate surface, abrasive grains having come off or grind dust may affect the substrate surface to tend to be deeply scratched in places, and scratches thus made may be left when photosensitive members are manufactured, to cause faulty images.

Japanese Patent Application Laid-open No. 6-35216, Japanese Patent No. 2668985, Japanese Patent Publication No. 7-15589 and Japanese Patent Application Laid-open No. 9-179322 also disclose a method in which the surface of an aluminum substrate is abraded by wet honing. This method is an effective way of providing a surface which is uneven without regularity. However, this can not prevent injection of electric charges from the substrate.

Meanwhile, methods have hitherto been proposed, as exemplified by a method in which the surface of an aluminum substrate is subjected to chromating to form a chromated chemical conversion coating, as disclosed in Japanese Patent Applications Laid-open No. 54-12733 and No. 57-62056; a method in which a boehmite coating is formed on the surface of an aluminum substrate, as disclosed in Japanese Patent Applications Laid-open No. 58-14841 and No. 64-29852; and a method in which the surface of an aluminum substrate is oxidized forcedly by high-temperature treatment to form an oxide film, as disclosed in Japanese Patent Applications Laid-open No. 57-29051.

With regard to, e.g., the method of chromating, substrates having a certain degree of performance can be obtained. However, since treating solutions contain chromium, it is very difficult to dispose of waste liquor, and also this is not preferable in view of environmental safety.

With regard to the boehmite treatment, the crystal state of the surface can not be said to be suited for substrates of electrophotographic photosensitive members. It can be effective to a certain degree with regard to electrophotographic performance, but, with regard to images, no satisfactory image quality has been achieved because the surface structure and shape are unsuited. Thus, under existing circumstances, those satisfying all performances have not been available.

What is aimed by the above surface treatment is that the film formed on the substrate surface prevents any non-uniformity from being caused in electrophotographic performances and images by electric charges injected locally from the substrate to the photosensitive layer.

As a method of preventing such local charge injection so as to cause no faulty images, a method is available in which the surface of an aluminum substrate is subjected to anodizing to provide a layer of aluminum oxide (e.g., Japanese Patent Applications Laid-open No. 2-7070 and No. 5-34964).

This method is a good method in order to attain such an aim. However, in order to form the layer uniformly without causing any uneven layer thickness on the substrate surface, it must be formed in a certain larger thickness, and a thickness of about 5 or 6 $\mu$m or more under usual conditions for its formation. Hence, the layer must be formed in a much larger thickness than the thickness actually required as a charge injection blocking layer, resulting in an increase in cost.

SUMMARY OF THE INVENTION

Accordingly, an object of the present invention is to provide a process by which an electrophotographic photosensitive member having good electrophotographic performances that may cause no faulty images in any environment of from low temperature/low humidity to high temperature/high humidity and also may less cause potential variations can be produced at a low cost and stably.

As a result of studies made in order to solve the problems discussed above, the present inventors have discovered the following: It is a very effective means to form on the substrate an insoluble coating with specific composition by applying specific chemical conversion to the surface of an aluminum substrate used in the electrophotographic photosensitive member, i.e., by chemical reaction between the substrate and an aqueous acid solution containing a specific metal element, without use of any electrical external force. This is effective in view of the advantages that the cost and environment can be made very less adversely affected and the production apparatus can be made simpler than in the anodizing.

In addition, as a preliminary step of this chemical conversion, the aluminum substrate is etched with at least one of an acid and an alkali. This makes it possible to obtain a substrate for electrophotographic photosensitive members having superior performances.

The present invention provides a process for producing an electrophotographic photosensitive member, comprising at least one of the following steps a) and b) and the following steps c) and d) of;

a) etching an aluminum substrate with at least one of an acid and an alkali;

b) abrading an aluminum substrate with an abrasive dispersion containing 5% by volume or more of a spherical abrasive having a 50% diameter of from 5 $\mu$m to 60 $\mu$m as measured in cumulative percentage;

c) subjecting the aluminum substrate having been processed by at least one of the steps a) and b), to chemical conversion with an aqueous acid solution containing a salt of titanium or a salt of zirconium; and d) forming a photosensitive layer on the aluminum substrate having been subjected to the chemical conversion.

DESCRIPTION OF THE PREFERRED EMBODIMENTS

Figure 1:
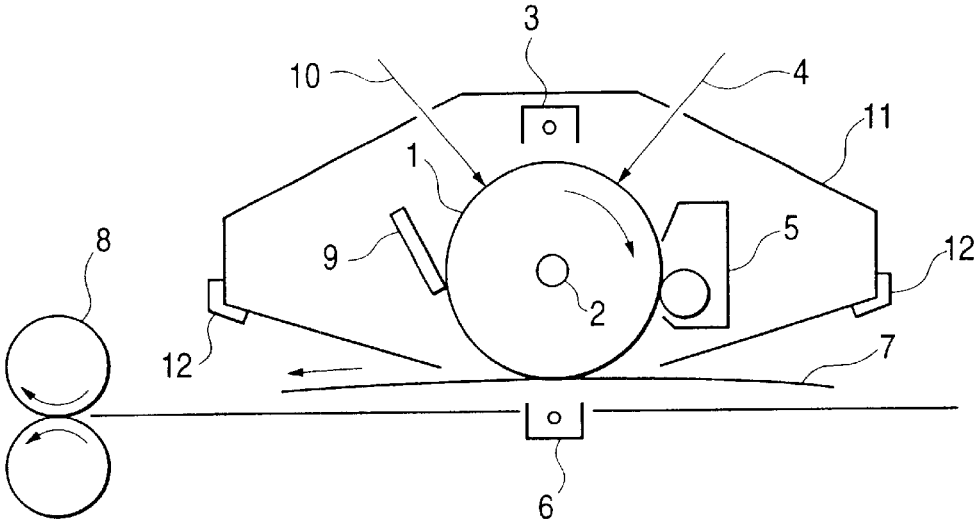
FIG. 1 is a schematic illustration of an example of the construction of an electrophotographic apparatus having a process cartridge having an electrophotographic photosensitive member produced by the process of the present invention.

The process of the present invention for producing an electrophotographic photosensitive member has, as a preliminary step of chemical conversion, at least one of the following steps a) and b) of;

a) etching an aluminum substrate with at least one of an acid and an alkali; and b) abrading an aluminum substrate with an abrasive dispersion containing 5% by volume or more of a spherical abrasive having a 50% diameter of from 5 $\mu$m to 60 $\mu$m as measured in cumulative percentage.

The etching in the present invention not only can remove stains or oily matter present on the substrate surfaces, but also can once remove oxide films present on the substrate surfaces to make it easy to form chemical conversion coatings by chemical conversion after the etching to improve the performance of the coatings.

In addition, as another effect of the etching, the following can be considered.

In aluminum, usually, various metals are contained as additives or impurities. These form eutectics as intermetallic compounds together with aluminum, and their microscopic masses dot the aluminum in islands. The intermetallic compounds are also present on the substrate surface as a matter of course. Any chemical conversion carried out thereon can not form chemical conversion coatings well at the part where such intermetallic compounds are present, and may form faulty coatings to bring about a possibility of affecting image characteristics.

Accordingly, before the chemical conversion is carried out, the eutectics of the intermetallic compounds are removed by etching. Thus, a chemical conversion coating very uniform and free of faults can be formed on the substrate surface and the chemical conversion can more remarkably be made effective, making it possible to obtain an electrophotographic photosensitive member having very good performances.

The acid usable in the etching in the present invention may include sulfuric acid, nitric acid, hydrofluoric acid and hydrochloric acid. Of these, sulfuric acid is particularly preferred as having properties of selectively dissolving oxide films or intermetallic compounds well and not so much dissolving aluminum. In a case of using sulfuric acid, the concentration of the solution is preferred within from 10 to 30% by weight.

The alkali may include sodium hydroxide, potassium hydroxide, sodium carbonate, sodium bicarbonate, sodium silicate and sodium phosphate. Of these, sodium hydroxide is particularly preferred as having the strongest etching power.

Incidentally, when the substrate is etched with the alkali, powdery residues called smuts may occur depending on the type of aluminum used as the substrate. Accordingly, in such a case, the substrate must be further immersed in an acid to remove them. To remove the smuts, nitric acid or sulfuric acid may be used. The etching may be carried out by immersing the aluminum substrate in the above solution, or by applying the above solution to the aluminum substrate by means of a spray, an so on. In a case of the immersion method, the treating time is preferred in from about 30 seconds to about 5 minutes and the solution temperature is preferred at from room temperature to about 70° C., but which are depending from the concentration of the solution used.

The step b), the step of abrading the aluminum substrate with an abrasive dispersion containing an abrasive, what is called wet honing, will be described below.

The abrasive used in the wet honing is usually chiefly comprised of polygonal particles. Such polygonal particles can abrade the aluminum substrate in a good efficiency on account of their sharp edges, and hence the desired surface roughness can be attained in a relatively short spraying time. However, the surface thus formed has the shape of sharp hills and valleys. In general, such an abrasive has a particle size distribution, and large abrasive particles tend to form large hills and valleys, and small ones small hills and valleys, thus it is difficult to achieve a uniformity of roughness.

However, the chemical conversion coatings (coatings formed by chemical conversion) in the present invention provide a thin film, and such sharp projections may cause disorder or insulation failure of the photosensitive layer. Hence, abrasive particles which are substantially spherical are used in the present invention. In this case, because they have no or relatively few sharp corners, they relatively a little act to abrade the aluminum substrate surface and rather more act to deform it by plastic working. Accordingly, the surface can have a shape of gentle unevenness and also have less difference in height or depth of hills and valleys ascribable to the particle size distribution of abrasive particles. Thus, more uniform roughness is achievable.

There is another problem of stick- or run-into of abrasive particles. In general, some polygonal abrasives have the action to cause micro-pulverization to self-produce cutting edges successively. As the result, a phenomenon may occur such that they stick or run into the surface of the aluminum substrate. At the part where such run-into has occurred, the chemical conversion coatings may be formed with difficulty to tend to cause faulty images.

However, when the substantially spherical abrasive as used in the present invention is used, its particles may run into the substrate surface with difficulty, and may run into it with difficulty also because of the deformation by plastic working.

There is still another problem of surface roughness. As will be detailed later, the chemical conversion coatings may have a total layer thickness of 1 μm or smaller. In such a layer thickness, the surface roughness may have a direct influence. Accordingly, its maximum height (Rmax) may preferably be from 0.5 to 3.0 μm, and ten-point average roughness (Rz) from 0.5 to 1.8 μm. If the maximum height is less than 0.5 μm, the roughness is so small that interference fringes may occur. If it is more than 3.0 μm, ground fog may occur. If the ten-point average roughness is less than 0.5 μm, the roughness is so small that interference fringes may occur. If it is more than 1.8 μm, the roughness is so large that poor images may be formed.

The substantially spherical abrasive used in the present invention is described below. Usable as the spherical abrasive are alumina material particles, zirconia material particles, silicon carbide material particles, iron material particles and glass particles. The alumina material particles include, but not limited to, alumina particles, alumina-silica particles and zircon-alumina particles.

Taking account of crushability by spraying, the abrasive may preferably be those having a Vickers hardness of 500 $kg/mm^2$ or higher, and more preferably 1,000 $kg/mm^2$ or higher.

The abrasive to be used has a 50% diameter of from 5 μm to 60 μm, preferably from 10 to 50 μm, and particularly preferably from 10 to 40 μm, as measured in cumulative percentage of volume average particle diameter by Coulter counter method by means of an aperture with 100 μm or an aperture with 200 μm. If it has a 50% diameter smaller than 5 μm, the desired surface roughness may be attained with difficulty. If it has a 50% diameter larger than 60 μm, the surface tends to have a too large roughness.

In view of a narrow particle size distribution and a ready availability, alumina particles may preferably be used. Such alumina particles may preferably be those having a bulk density of from 1.6 to 2.3 $g/cm^3$. Those having a bulk density lower than 1.6 $g/cm^3$ have a polygonal shape in many cases, and may be unsuitable for use.

The abrasive may preferably be sprayed at a velocity ranging from 20 to 80 m/sec., which may appropriately be selected depending on the desired roughness and the particle diameter of the abrasive used.

When it is required to attain a uniform surface roughness and a gentler surface unevenness, the abrasive may preferably be sprayed at 90° or less of a spray angle which formed where the central axis of spraying and the central axis of the aluminum substrate across each other. This is because the spraying at a spray angle of 90° or less can make the abrasive collide against the cylindrical tube at a low pressure and also at a more uniform pressure distribution. The abrasive may more preferably be sprayed at a spray angle ranging from 60° to 30°, and particularly preferably from 60° to 45°. The angle may be either of an upward angle and a downward angle with respect to the cylindrical tube surface of the aluminum substrate.

The abrasive is dispersed in a dispersion medium to prepare the abrasive dispersion used in the present invention. The dispersion medium may be selected on the condition that it does not cause the abrasive to agglomerate. In particular, water is preferred in view of various factors. The abrasive may be dispersed in the dispersion medium in an amount not more than 25% by volume, and particularly preferably from 5 to 15% by volume, based on the volume of the abrasive. If it is in an amount less than 5% by volume, the abrasion step takes a too long time. If it is in an amount more than 15% by volume, and also more than 25% by volume, the abrasive may poorly be dispersed when sprayed.

The aluminum substrate cylindrical tube may preferably have a surface roughness of 2 μm or less in Rmax and 0.7 μm or less in Rz. This is because the substantially spherical abrasive chiefly acts to deform the substrate surface by plastic working and less acts to decrease the original roughness, in particular, Rmax. The cylindrical tube may preferably have a surface roughness of 1.5 μm or less in Rmax and 0.5 μm or less in Rz.

As the aluminum substrate cylindrical tube, non-ground drawn tubes or surface-ground tubes may appropriately be used. Especially when surface-ground tubes are used, the tube may preferably be a tube ground to have Rz of 0.7 μm or less so that grind working marks can be controlled not to have any influence.

After the abrasion in the present invention has been carried out, the aluminum substrate may be washed, where it is suitable to wash it with water using water jet streams. It is more effective to carry out the washing with water using a suitable surface-active agent and ultrasonic waves in combination.

The surface roughness is measured with a surface roughness measuring device (SURFCORDER SE-3300, manufactured by Kosaka Kenkyusho) under conditions of a cut-off value of 0.8 mm, a standard length of 0.8 mm, an evaluation length of 8.0 mm and Gaussian filter.

After at least one of the steps a) and b) has been completed, the aluminum substrate is subjected to chemical conversion with an aqueous acid solution containing a salt of titanium or a salt of zirconium.

The chemical conversion referred to in the present invention is treatment where a substrate is brought into contact with a specific solution to form on the substrate a coating having specific composition, without applying any electrical external force as in anodizing.

Metals of the metal salts used in the present invention are titanium and zirconium. The aluminum substrate having a chemical conversion coating of the present invention in which any one of titanium and zirconium is present together with aluminum and oxygen has very good properties as a substrate for electrophotographic photosensitive members.

The salt of titanium and the salt of zirconium may preferably be fluorine compounds. The salt of titanium may include titanium hydrogenfluoride, a sodium salt, potassium salt or ammonium salt thereof, and titanium sulfate. The salt of zirconium may include potassium zircon fluoride and zirconium sulfate.

The aqueous acid solution may contain the metal salt in a concentration of from 0.01 g to 2 g/liter as weight of metal.

The aqueous acid solution may also preferably contain fluorine ions in a concentration ranging from 0 g to 10 g/liter. Within this range, etching reaction may appropriately take place on the substrate surface and a uniform coating can be formed with ease.

The aqueous acid solution of the present invention may have a pH adjusted within the range of from 1.0 to 5.5 using ammonia or sodium hydroxide. If it has a pH below 1.0, the etching reaction may take place violently to make it difficult to obtain a good coating. If it has a pH above 5.5, the coating may be formed at so low a rate that only a thin coating can be obtained, making it difficult to obtain a remarkable effect of the present invention.

In the present invention, in view of an advantage that the reaction takes place stably, the aqueous acid solution may preferably be heated to 30 to 90° C. when used.

As methods for bringing the substrate into contact with the aqueous acid solution, either method of dipping and spraying may be used. Dipping is preferred in view of production efficiency.

The substrate having been subjected to the chemical conversion is used after it is washed and dried.

The composition of the substrate surface portion in the present invention is measured by scanning Auger electron ray spectroscopy, and is defined to be the one within the range of from the uppermost surface to a depth of $5\times10^{-3}$ $\mu$m (50 Å).

In the present invention, the titanium or zirconium may be contained in an amount ranging from 4 to 100 atom%.

The chemical conversion coating containing titanium or zirconium, formed on the substrate surface may preferably have a total layer thickness of 1 $\mu$m or smaller, and more preferably $5\times10^{-3}$ $\mu$m (50 Å) or larger. If the coating is in a layer thickness larger than 1 $\mu$m, electric charges can escape with difficulty in excess to tend to cause an increase in residual potential or cause fog. If it is in a layer thickness smaller than $5\times10^{-3}$ $\mu$m (50 Å), a remarkable effect of the present invention may be obtained with difficulty.

In the present invention, in view of corrosion resistance and adhesion of coating films, the aqueous acid solution may preferably further contain a phosphoric acid, a phosphate, a tannin or a tannic acid.

The phosphoric acid may include phosphoric acid and sodium, potassium or ammonium salts thereof. The phosphate may include pyrophosphoric acid, tripolyphosphoric acid, hexametaphosphoric acid, and condensed phosphates of alkali metal salts, such as sodium salts or potassium salts of any of these. Also usable are organic phosphoric acid compounds such as phytic acid, nitrodiethanolethylene phosphonic acid, 2-hydroxyethylmetaalkyl-1-acid phosphonic acid, 2-ethylhexyl acid phosphonic acid and ethane-1-hydroxy-1,1-diphosphonic acid.

The phosphoric acid or phosphate in the aqueous acid solution may preferably be in a concentration ranging from 0.05 to 50 g/liter in terms of phosphate ions. Within this range, an especially uniform and good chemical conversion coating can be formed and also the treating solution can have an especially good stability.

The tannin or tannic acid may include quebracho tannin, depside tannin, Chinese tannic acid, Turkish tannic acid, hamamelitannic acid, chebulinic acid, sumac tannin, Chinese gallotannic acid and ellagic acid tannin.

The tannin or tannic acid in the aqueous acid solution may preferably be in a concentration ranging from 0.1 to 10 g/liter.

In the present invention, hydrofluoric acid, borofluoric acid, hydrosilicofluoric acid or a salt of any of these may preferably be added to the aqueous acid solution. These compounds have the function to etch the substrate surface when the substrate is subjected to chemical conversion, and hence a very uniform chemical conversion coating can be formed.

From the foregoing, it is preferable for the chemical conversion coating of the present invention to contain phosphorus and fluorine.

There are no particular limitations on the aluminum substrate so long as it comprises aluminum, which may include pure aluminum and aluminum alloys such as Al—Mn, Al—Mg, Al—Cu, Al—Si, Al—Mg—Si and Al—Cu—Si types. Stated more specifically, aluminum of 6000 types such as JIS A6063 and aluminum of 3000 types such as JIS A3003 may be used. There are also no particular limitations on its shape. It may preferably be in the form of a drum. It may also preferably be a crude tube produced by hot extrusion processing, an electroseamed tube produced by pressure-welding hot-rolled sheets or an electric arc welded tube produced by TIG-welding hot-rolled sheets. In particular, the crude tube produced by hot extrusion processing is preferred.

In the present invention, as a further preliminary step of the wet honing, the aluminum substrate may also be cut with a diamond bite. Cutting the substrate as a preliminary processing enables the wet honing to be carried out at a milder air pressure and a shorter time than conventional conditions, taking account of the surface roughness.

In the present invention, an aluminum crude tube is cut on a lathe using a diamond bite. As the bite, diamond bites arranged in plurality may be used. This is preferable because the crude tube can be cut in a very short time.

More specifically, in conventional cutting lathes, the bite has one cutting edge, and the cutting edge is forwarded at a pitch of from 0.01 to 0.05 mm in relation to the shape of hills to be cut, where the crude tube is worked at a number of revolutions of from 2,000 to 3,000 rpm. Hence, the time taken for cutting one crude tube of, e.g., 250 mm diameter is about 100 seconds at the fastest.

As the diamond bite for the cutting in the present invention, it is preferable to use diamond miracle bites arranged in plurality (preferably 3 to 5 bites) and in a line at equal intervals.

Thus, it becomes possible to forward the cutting edge not by 1 pitch but by 3 to 5 pitches per revolution, so that the crude tube can be cut at a speed three to five times the conventional cutting and can be worked in a very short time of 20 to 30 seconds per tube.

The photosensitive layer of the electrophotographic photosensitive member, formed in the step d) of the process of the present invention, will be described below.

Constitution of the photosensitive layer in the present invention is grouped roughly into a single-layer type in which a charge-generating material and a charge-transporting material are contained in the same layer and a multi-layer type having a charge generation layer containing a charge-generating material and a charge transport layer containing a charge-transporting material.

An electrophotographic photosensitive member having the multi-layer type photosensitive layer will be described below.

The photosensitive member may be constituted in the manner that the charge generation layer and the charge transport layer are layered on the substrate in this order or conversely the charge transport layer and the charge generation layer are layered in this order.

The charge transport layer is formed by coating a coating solution prepared by dissolving a charge-transporting material such as a polycyclic aromatic compound having a biphenylene, anthracene, pyrene or phenanthrene structure, a nitrogen-containing cyclic compound such as indole, carbazole, oxadiazole or pyrazoline, a hydrazone compound or a styryl compound in a resin having film forming properties, followed by drying.

The resin having film forming properties may include polyesters, polycarbonates, polystyrenes, polymethacrylates and polyallylates.

The charge transport layer may preferably have a layer thickness of from 5 to 40 μm, and preferably from 10 to 30 μm.

The charge generation layer is formed by coating a dispersion prepared by dispersing a charge-transporting material such as an azo pigment such as Sudan Red or Dyan Blue, a quinone pigment such as pyrene, quinone or anthanthrone, a quinocyanine pigment, a perylene pigment, an indigo pigment such as indigo or thioindigo or a phthalocyanine pigment in a resin such as polyvinyl butyral, polystyrene, or polyvinyl acetate or acrylate, followed by drying, or formed by vacuum deposition of the above pigment.

The charge generation layer may preferably have a layer thickness of 5 μm or smaller, and preferably from 0.01 to 3 μm.

The single-layer type photosensitive layer is formed by coating a coating fluid prepared by dispersing and dissolving the charge-generating material and the charge-transporting material in the resin, followed by drying. Such a photosensitive layer may preferably have a layer thickness of from 5 to 40 μm, and preferably from 10 to 30 μm.

In the present invention, a subbing layer having the function as a barrier and the function of adhesion may be provided between the support and the photosensitive layer. The subbing layer is formed by coating a solution prepared by dissolving casein, nitro cellulose, ethylene-acrylic acid copolymer, alcohol-soluble polyamide, polyurethane or gelatin, followed by drying.

The subbing layer may preferably have a layer thickness of from 0.1 to 3 μm.

In the present invention, a protective layer may be provided on the photosensitive layer.

The protective layer may be constituted of a material including polyester, polyacrylate, polyethylene, polystyrene, polybutadiene, polycarbonate, polyamide, polypropylene, polyimide, polyamide-imide, polysulfone, polyacrylic ether, polyacetal, phenol, acrylic, silicone, epoxy, urea, allyl, alkyd, butyral, phenoxy, phosphazene, acryl-modified epoxy, acryl-modified urethane and acryl-modified polyester resins.

The protective layer may preferably have a layer thickness of from 0.2 to 10 μm.

In the above respective layers, a lubricant such as polytetrafluoroethylene, polyvinylidene fluoride, fluorine type graft polymer, silicone type graft polymer, fluorine type block polymer, silicone type block polymer or silicone oil may be incorporated in order to improve cleaning performance and wear resistance.

Additives such as an antioxidant may further be added for the purpose of improving weatherability.

In the protective layer, conductive powder such as conductive tin oxide or conductive titanium oxide may be dispersed for the purpose of resistance control.

FIG. 1 schematically illustrates the construction of an electrophotographic apparatus having a process cartridge having the electrophotographic photosensitive member produced by the process of the present invention.

In FIG. 1, reference numeral 1 denotes a drum type electrophotographic photosensitive member of the present invention, which is rotatingly driven around an axis 2 in the direction of an arrow at a given peripheral speed. The photosensitive member 1 is uniformly electrostatically charged on its periphery to a positive or negative, given potential through a primary charging means 3. The photosensitive member thus charged is then exposed to light 4 emitted from an exposure means (not shown) for slit exposure or laser beam scanning exposure. In this way, electrostatic latent images are formed successively on the periphery of the photosensitive member 1.

The electrostatic latent images thus formed are subsequently developed by toner by the operation of a developing means 5. The toner-developed images formed by development are then transferred successively by the operation of a transfer means 6, to the surface of a transfer medium 7 fed from a paper feed section (not shown) to the part between the photosensitive member 1 and the transfer means 6 in the manner synchronized with the rotation of the photosensitive member 1.

The transfer medium 7 which has received the images is separated from the surface of the photosensitive member, is led through an image fixing means 8, where the images are fixed, and is then printed out of the apparatus as a copied material (a copy).

The surface of the photosensitive member 1 from which images have been transferred is brought to removal of the toner remaining after the transfer, through a cleaning means 9. Thus, the photosensitive member is cleaned on its surface, further subjected to charge elimination by pre-exposure light 10 emitted from a pre-exposure means (not shown), and then repeatedly used for the formation of images. When the primary charging means is a contact charging means making use of a charging roller, the pre-exposure is not necessarily required.

In the present invention, the apparatus may be constituted of a combination of plural components integrally joined as a process cartridge from among the constituents such as the above electrophotographic photosensitive member 1 , primary charging means 3 , developing means 5 and cleaning means 9 so that the process cartridge is detachably mountable to the body of the electrophotographic apparatus such as a copying machine or a laser beam printer. For example, at least one of the primary charging means 3 , the developing means 5 and the cleaning means 9 may be integrally supported in a cartridge together with the photosensitive member 1 to form a process cartridge 11 that is detachably mountable to the body of the apparatus through a guide means such as a rail 12 provided in the body of the apparatus.

In the case when the electrophotographic apparatus is used as a copying machine or a printer, the exposure light 4 is light reflected from, or transmitted through, an original, or light irradiated by the scanning of a laser beam, the driving of an LED array or the driving of a liquid crystal shutter array according to signals obtained by reading an original through a sensor and converting the information into signals.

The electrophotographic photosensitive member of the present invention may be not only applied in electrophotographic copying machines, but also widely applied in the fields where electrophotography is applied, e.g., laser beam printers, CRT printers, LED printers, liquid-crystal printers and laser beam engravers.

The present invention will be described below in greater detail by giving Examples.

EXAMPLE 1

An aluminum cylinder of 29.92 mm in outer diameter, 28.5 mm in inner diameter and 254 mm in length was prepared.

This aluminum cylinder was degreased and washed with surfactant, and then was etched by immersing it in 20% sulfuric acid solution heated to 60° C. for 3 minutes while shaking.

An aqueous acid solution (trade name: PALCOAT 3753, available from Nihon Parkerizing Co., Ltd.; pH: 3.8) containing phytic acid as an organic phosphoric acid and titanium hydrogenfluoride and ammonium titanium fluoride as salts of metals was kept at a temperature of 40° C., and the above aluminum cylinder was immersed in this aqueous acid solution to make chemical conversion for 1 minute, which was then washed with pure water, followed by air-drying. The chemical conversion coating thus formed was in a layer thickness of $2\times10^{-2}\mu$m (200 Å).

Next, 4 parts by weight of oxytitanium phthalocyanine, 2 parts by weight of polyvinyl butyral resin (trade name: BX-1, available from Sekisui Chemical Co. Ltd.) and 34 parts by weight of cyclohexanone were dispersed for 8 hours by means of a sand mill, followed by addition of 60 parts by weight of tetrahydrofuran to make up a charge generation layer coating dispersion.

This dispersion was dip-coated on the aluminum cylinder having been subjected to chemical conversion, followed by drying with heating at 90° C. for 10 minutes to form a charge generation layer with a layer thickness of 0.2 $\mu$m.

Next, a solution prepared by dissolving 50 parts by weight of a triarylamine compound represented by the following formula and 50 parts by weight of bisphenol-Z polycarbonate resin in 400 parts by weight of monochlorobenzene was dip-coated on the charge generation layer, followed by drying with heating at 110° C. for 1 hour to form a charge transport layer with a layer thickness of 20 $\mu$m.

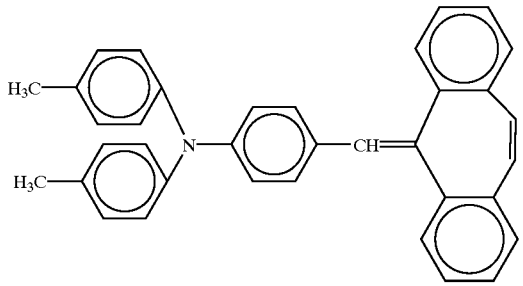

Evaluation

Figure 2:
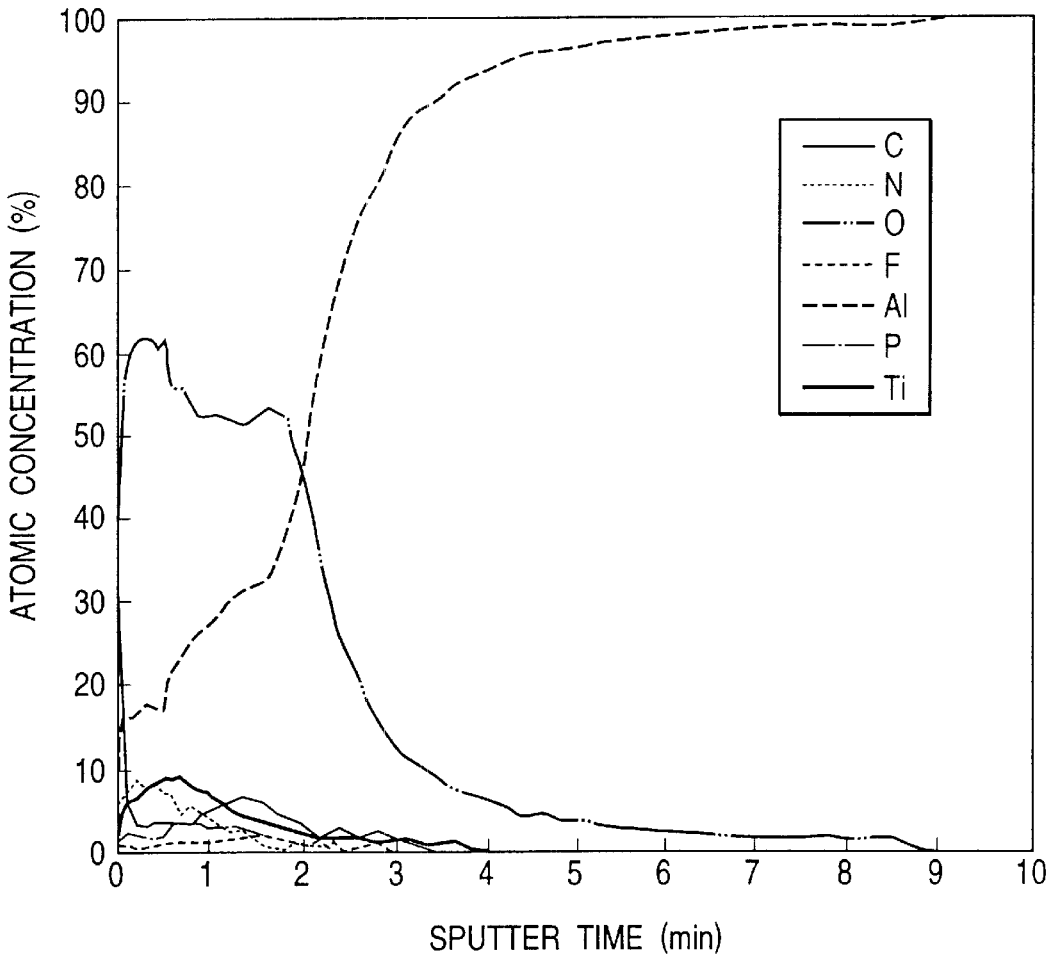
FIG. 2 is a graph showing compositional ratio of elements constituting the surface portion of an aluminum substrate the electrophotographic photosensitive member produced by the process of the present invention has.

The surface portion of the substrate having been subjected to chemical conversion, washing and drying was examined by elementary analysis using a scanning Auger electron ray spectroscope while making argon ion etching from the uppermost surface in the depth direction of the substrate. As the result, aluminum, titanium and oxygen were detected as main constituent elements. Their graphic representation is given in FIG. 2. In the present Example, the relationship between depth and sputter time is $1.1\times10^{-3}$ $\mu$m (110 Å)/min in terms of $SiO_2$. This value is appropriately changeable.

The compositional ratio of elements at the uppermost surface of the substrate and a depth of $5\times10^{-3}$ $\mu$m (50 Å) from the uppermost surface is shown in Table 1 as elementary percentage regarding the amount of aluminum element as 100.

As can be seen from these results, the chemical conversion coating on the substrate surface comprises an oxidized aluminum coating in which titanium has been incorporated. As the result of analysis, nitrogen, fluorine, phosphorus and so forth are detected as other elements contained. These elements are considered to be those originally contained in the phosphoric acid and fluorine compound in the aqueous acid solution used when the chemical conversion is made, and incorporated in the chemical conversion coating.

Next, the electrophotographic photosensitive member obtained was left for 48 hours in environment of normal temperature/normal humidity (23° C., 60%RH), high temperature/high humidity (32.5° C., 85%RH) or low temperature/low humidity (15° C., 10%RH), and thereafter set in a commercially available laser beam printer of a reverse development system to reproduce solid white images in each environment.

The state of background fog in the solid white images thus formed was visually evaluated. The results are shown in Table 2.

Simultaneously, values of dark-area potential and light-area potential were measured in each environment. The results are shown in Table 2.

EXAMPLE 2

An electrophotographic photosensitive member was produced in the same manner as in Example 1 except that etching treatment was conducted in such a manner that first an aluminum cylinder was immersed in 3% sodium hydroxide solution heated to 40° C. for 20 seconds, followed by water washing, then it was immersed in 15% nitric acid solution for 1 minute, followed by water washing again, and that a solution (trade name: PALCOAT 3756, available from Nihon Parkerizing Co., Ltd.; pH: 3.2) containing tannic acid, an ammonium salt as an aqueous acid solution for chemical conversion treatment, and zirconium fluoride and zirconium sulfate as salts of metals was used. And evaluation was made similarly. The results are shown in Tables 1 and 2. The chemical conversion coating was in a layer of $1.5\times10^{-2}$ $\mu$m (150 Å) thickness.

EXAMPLE 3

An electrophotographic photosensitive member was produced in the same manner as in Example 1 except that the concentration of sulfuric acid solution used was 60%, and that a solution (trade name: PALCOAT 3753T, available from Nihon Parkerizing Co., Ltd.; pH: 3.5) containing phytic acid as an aqueous acid solution for chemical conversion treatment, and zirconium hydrofluoric acid and zirconium ammonium fluoride as salts of metals was used. And evaluation was made similarly. The results are shown in Tables 1 and 2. The chemical conversion coating was in a layer of $1.8\times10^{-2}$ $\mu$m (180 Å) thickness.

COMPARATIVE EXAMPLE 1

An electrophotographic photosensitive member was produced in the same manner as in Example 1 except that the etching and the chemical conversion were not carried out. Evaluation was made similarly. The results are shown in Table 2.

COMPARATIVE EXAMPLE 2

Ammonia water with a concentration of 0.3% was prepared, and this was heated to 95° C.

In this heated ammonia water, the same aluminum cylinder as that used in Example 1 and having not been subjected to chemical conversion was immiersed for 5 minutes to make surface treatment, followed by drying to form a boehmite coating on the cylinder surface.

An electrophotographic photosensitive member was produced in the same manner as in Example 1 except that this aluminum cylinder was used instead. Evaluation was made similarly. The results are shown in Table 2.

COMPARATIVE EXAMPLE 3

Chemical conversion was carried out by immersing an aluminum cylinder for 1 minute in, in place of the aqueous acid solution of the present invention, a chromium phosphate type solution for chemical conversion (trade name: ALUCHROME 3701, available from Nihon Parkerizing Co., Ltd.) kept at 30° C., containing neither titanium nor zirconium, to form a chromate type chemical conversion coating on the surface of the cylinder.

An electrophotographic photosensitive member was produced in the same manner as in Example 1 except that this aluminum cylinder was used instead. Evaluation was made similarly. The results are shown in Table 2.

REFERENCE EXAMPLE

An electrophotographic photosensitive member was produced in the same manner as in Example 1 except that only the chemical conversion was carried out without carrying out the etching. Evaluation was made similarly. The results are shown in Table 2.

PROCESSING EXAMPLE 1

The material of aluminum alloy JIS A 3003 was subjected to continuous extrusion molding by porthole extruding into a pipe 30.0 mm in outer diameter, 28.5 mm in inner diameter, and this was cut into cylindrical pipes 254 mm in length. The cylindrical pipes thus obtained had Rmax of 1.5 μm and Rz of 0.6 μm.

The cylindrical pipes were subjected to grinding with a liquid honing apparatus (available from FUJI SEIKI CO., LTD.) under the conditions described below.

Concentration of abrasive solution: 4 liters of abrasive was put into 40 liters of water.

Abrasive: spheroidal alumina particles (ALUMINA BEADS CB-A20S, available from Showa Titanium Co., Ltd.), the diameter was 20.1 μm for 50% diameter on the basis of accumulative percentage, the bulk density was 2.0 g/cc, the shape observed with a microscope was almost spheroidal.

Rotational speed of cylindrical pipe: 100 rpm

Distance from gun: 150 mm

Angle of gun: lower angle 45 degrees

Nozzle diameter of gun: 8 mm

Gun feed speed: 800 mm/min

Air-pressure: $10.1\times10^{-2}$ MPa (1.1 kgf/cm$^2$)

One reciprocation of grinding was conducted under the above conditions, followed by cleaning with a cleaner using jet water. Then cleaning was conducted again with deionized water using an ultrasonic oscillator jointly.

The surface roughness of the aluminum substrate thus obtained was measured with SURFCODER SE-3300, available from Kosaka Research & Development Institute. As a result, Rmax was 1.7 μm and Rz was 1.0 μm. Rz measured at 12 points of a single substrate ranged from 0.95 to 1.05 μm, which was satisfactory. The surface observed with a microscope was gently uneven. And microscopic observation also showed that there was no abrasive sticking in the substrate.

PROCESSING EXAMPLE 2

The material of aluminum alloy JIS A 6063 was subjected to continuous extrusion molding by porthole extruding into a pipe 30.15 mm in outer diameter, 28.5 mm in inner diameter, and this was cut into cylindrical pipes 255 mm in length. Then the cylindrical pipes thus obtained were subjected to machinery cut into pipes 30.0 mm in outer diameter, 254 mm in length. At this point, Rmax was 1.1 μm and Rz 0.4 μm.

The cylindrical pipes were subjected to grinding with a liquid honing apparatus (available from FUJI SEIKI CO., LTD.) under the conditions described below.

Concentration of abrasive liquid: 4 liters of abrasive was put into 40 liters of water. Abrasive: spheroidal alumina particles (ALUMINA BEADS CB-A20S, available from Showa Titanium Co., Ltd.), the diameter was 20.1 μm for 50% diameter on the basis of accumulative percentage, the bulk density was 2.0 g/cc, the shape observed with a microscope was almost spheroidal.

Rotational speed of cylindrical pipe: 100 rpm

Distance from gun: 200 mm

Angle of gun: lower angle 60 degrees

Nozzle diameter of gun: 8 mm

Gun feed speed: 800 mm/min

Air-pressure: $10.1\times10^{-2}$ MPa (1.1 kgf/cm$^2$)

One reciprocation of grinding was conducted under the above conditions, followed by cleaning with a cleaner using jet water. Then cleaning was conducted again with deionized water using an ultrasonic oscillator jointly.

The surface roughness of the aluminum substrate thus obtained was measured with SURFCODER SE-3300, available from Kosaka Research & Development Institute. Rmax was 1.5 μm and Rz was 1.2 μm. Rz measured at 12 points of a single substrate ranged from 1.1 to 1.3 μm, which was satisfactory. The surface observed with a microscope was gently uneven. And microscopic observation also showed that there was no abrasive sticking in the substrate.

PROCESSING EXAMPLE 3

Grinding processing was conducted under the same conditions as in Processing Example 1 except that abrasive was changed from CB-A20S to CB-A30S (available from Showa Titanium Co., Ltd.). The diameter was 30.2 μm for 50% diameter on the basis of accumulative percentage, the bulk density was 2.1 g/cc, the shape observed with a microscope was almost spheroidal.

As a result, Rmax was 2.0 μm, Rz was 1.5 μm. Rz measured at 12 points of a single substrate ranged from 1.4 to 1.6 μm, which was satisfactory. The surface was gently uneven. And there was no abrasive sticking in the substrate.

PROCESSING EXAMPLE 4

Grinding processing was conducted under the same conditions as in Processing Example 2 except that gun angle was changed to 45°.

As a result, Rmax was 1.4 μm, Rz was 0.9 μm. Rz measured at 12 points of a single substrate ranged from 0.85 to 0.97 μm, which was satisfactory. The surface was gently uneven. And there was no abrasive sticking in the substrate.

REFERENCE PROCESSING EXAMPLE 1

Grinding processing was conducted under the same conditions as in Processing Example 1 except that abrasive was changed from CB-A20S to TOSAEMIRY-A1200 (available from Uji Electrochemical Industry Co., Ltd.). The diameter was 6.7 μm for 50% diameter on the basis of accumulative percentage, the shape observed with a microscope was polygonal. Grinding was further conducted under the same conditions except that air-pressure was changed from $10.1\times10^{-2}$ MPa (1.1 kgf/cm$^2$) to $29.4\times10^{-2}$ MPa (3.0 kgf/cm$^2$).

As a result, Rmax was 3.5 μm, Rz was 0.7 μm. Rz measured at 12 points of a single substrate ranged from 0.5 to 0.9 μm, which means that it was inferior in uniformity. The shape of the surface consisted of sharp projections and depressions. And there was observed abrasive sticking in the substrate.

EXAMPLE 4

An electrophotographic photosensitive member was produced in the same manner as in Example 1 except that the aluminum substrate obtained in Processing Example 1 was used as an aluminum cylinder, the temperature of 20% aqueous sulfuric acid solution was 40° C., the drying temperature of a charge generating layer was 95° C., and that a visual observation of the presence of interference fringes was added to evaluation items. And evaluation was made similarly.

The same results as in Example 1 were obtained, in addition, an excellent image free from interference fringes was obtained. The constituent elements of the substrate surface were the same as in Example 1 after chemical conversion treatment.

EXAMPLE 5

An electrophotographic photosensitive member was produced in the same manner as in Example 4 except that the aluminum cylinder of Processing Example 2 was used, and that a solution (trade name: PALCOAT 3756, available from Nihon Parkerizing Co., Ltd.; pH: 3.2) containing tannic acid, an ammonium salt as an aqueous solution for chemical conversion treatment, and zirconium fluoride and zirconium sulfate as salts of metals was used. And evaluation was made similarly.

The same results as in Example 2 were obtained, in addition, an excellent image free from interference fringes was obtained. The constituent elements of the substrate surface were the same as in Example 2 after chemical conversion treatment.

EXAMPLE 6

An electrophotographic photosensitive member was produced in the same manner as in Example 4 except that the aluminum cylinder of Processing Example 3 was used, and that a solution (trade name: PALCOAT 3753T, available from Nihon Parkerizing Co., Ltd.; pH: 3.5) containing phytic acid as an aqueous solution for chemical conversion treatment, and zirconium hydrofluoric acid and zirconium ammonium fluoride as salts of metals was used. And evaluation was made similarly.

The same results as in Example 3 were obtained, in addition, an excellent image free from interference fringes was obtained. The constituent elements of the substrate surface were the same as in Example 3 after chemical conversion treatment.

EXAMPLE 7

An electrophotographic photosensitive member was produced in the same manner as in Example 4 except that the aluminum cylinder of Processing Example 4 was used, and that a solution (trade name: ALUSURF 301 N-1, available from Nihon Paint Co., Ltd.; pH: 4.0) containing phosphoric acid as an aqueous solution for chemical conversion treatment, and zirconium fluoride and a sodium salt of zirconium hydrofluoric acid as salts of metals was used. And evaluation was made similarly. The results are shown in Tables 3 and 4. The chemical conversion coating was in a layer of $3.0\times10^{-2}$ μm (300 Å).

EXAMPLE 8

An electrophotographic photosensitive member was produced in the same manner as in Example 4 except that etching treatment was not carried out. And evaluation was made similarly.

As a result, no interference fringes were generated, and the other properties were the same as those of Reference Example.

EXAMPLE 9

An electrophotographic photosensitive member was produced in the same manner as in Example 4 except that the aluminum cylinder of Reference Processing Example 1 was used. And evaluation was made similarly. A few black spots were observed to be generated.

COMPARATIVE EXAMPLE 4

An electrophotographic photosensitive member was produced in the same manner as in Example 4 except that chemical conversion treatment was not carried out. And evaluation was made similarly.

As a result, no interference fringes were generated, and the other properties were almost the same as those of Comparative Example 1.

EXAMPLE 10

Aluminum raw pipes 2 30.5 mm in outer diameter, 28.5 mm in inner diameter, 250 mm in length, with a run-out accuracy of 100 μm and a surface roughness Rz of 10 μm were prepared from aluminum alloy JIS A 6063 by hot extruding.

Figure 3:
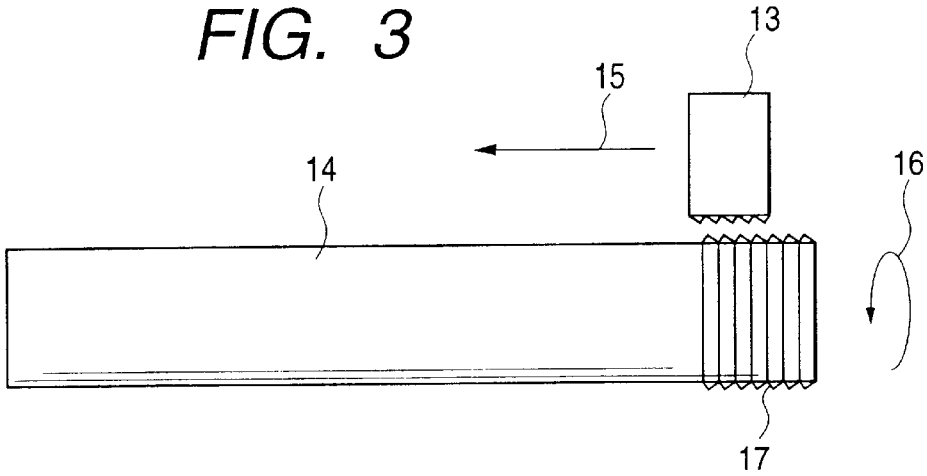
FIG. 3 is a schematic illustration of a grinding step used in the process of the present invention.
Figure 4:
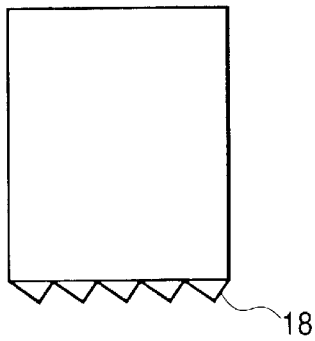
FIG. 4 is a schematic illustration of a bite used in the grinding step in the process of the present invention.

FIGS. 3 and 4 are schematic views showing the cutting process of the aluminum pipes.

The above raw pipes 14 were mounted on a lathe by chuck, and subjected to machinery cut with a cutting tool 13 in which five diamond single point tools 18 were spaced at intervals of 0.5 mm in a row so that they would have an outer diameter of 30.0±0.02 mm, a run-out accuracy of 15 μm, a surface roughness Rz=0.9 μm. In this case, the number of revolutions (in the direction 16) of the main shaft were 3000 rpm, the feed speed 3 (in the direction 15) of the cutting tool was 0.3 mm/rev, and the production time was 16.7 seconds. Reference numeral 17 denotes traces of machinery cuts.

Figure 5:
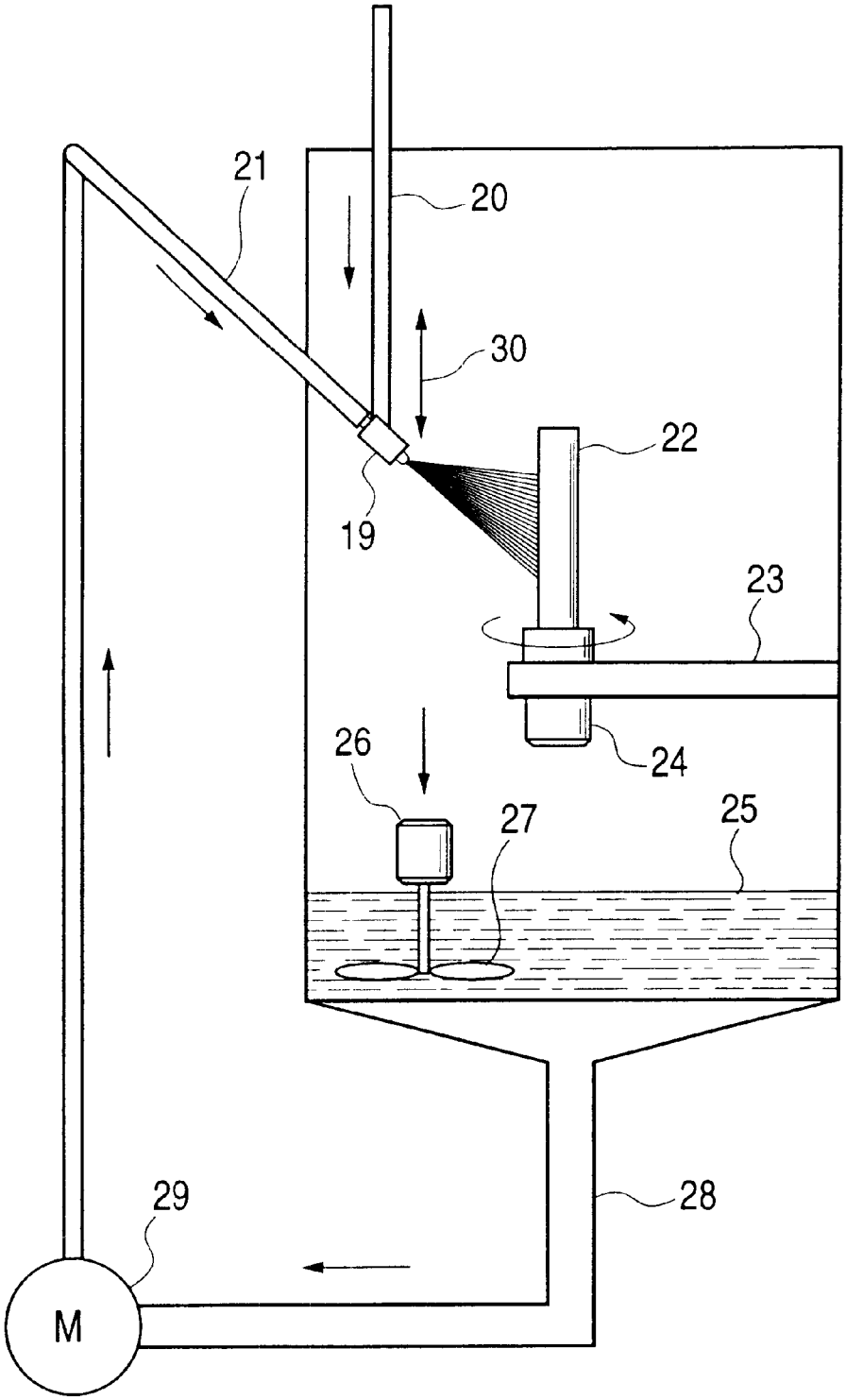
FIG. 5 is a schematic illustration of an apparatus for carrying out wet honing used in the process of the present invention.

The aluminum pipes having been subjected to machinery cuts were then subjected to wet honing processing with a wet honing apparatus shown in FIG. 5 under the conditions described below. In the figure, reference numeral 19 denotes a gun, numeral 20 an air-supplying pipe, numeral 21 a circulation pipe for abrasive solution, numeral 22 an aluminum substrate, numeral 23 a stand, numeral 24 a rotary motor, numeral 25 an abrasive solution, numeral 26 a stirring motor, numeral 27 a stirring propeller, numeral 28 an abrasive solution recovery pipe, numeral 29 an abrasive solution circulating pump, and numeral 30 a moving direction of the gun.

(Wet Honing Conditions)

Abrasive=ALUMINA BEADS CB-A20S (available from Showa Titanium Co., Ltd.)

Dispersion medium=Water, Abrasive/ Dispersion medium=1/10 (volume ratio)

Number of revolutions of aluminum pipes having been subjected to machinery cut=100 rpm, Pressure of air-spraying=0.1 Mpa, Gun moving speed=0.8 m/min Honing processing time=19 sec For the surface roughness of the cylinder after honing processing, Rmax was 1.5 μm, Rz 1.0 μm, Ra 0.15 μm, and Sm 40 μm.

An electrophotographic photosensitive member was produced in the same manner as in Example 4 except that the aluminum substrate obtained described above was used as an aluminum cylinder. And evaluation was made similarly.

As a result, the electrophotographic photosensitive member was excellent in all the fog property, electric potential property and interference fringe property.

EXAMPLE 11

An electrophotographic photosensitive member was produced in the same manner as in Example 10 except that a cutting tool in which 3 diamond single point tools were arranged in a row was used, the feeding speed of the cutting tool was 0.25 mm/rev, and producing time was 20 seconds. And evaluation was made similarly.

As a result, the electrophotographic photosensitive member was excellent in all the fog property, potential property and interference fringe property.

EXAMPLE 12

An electrophotographic photosensitive member was produced in the same manner as in Example 10 except that a cutting tool in which 5 diamond single point tools were arranged in a row was used, the number of revolutions of the main shaft was 4,000 rpm, the feeding speed of the cutting tool was 0.25 mm/rev, and the producing time was 20 seconds.

As a result, the electrophotographic photosensitive member was excellent in all the fog property, potential property and interference fringe property.

TABLE 1

| Measured at: | Percentage of the number of atoms of each element to the number of aluminum atoms (atom %) | | | | | | | |
|---|---|---|---|---|---|---|---|---|
| | Aluminum | Titanium | Zirconium | Oxygen | Nitrogen | Fluorine | Phosphorus | Carbon |
| Example 1 | | | | | | | | |
| Uppermost surface: | 100 | 32.8 | — | 470 | 80.3 | 7.2 | 14.8 | 503.1 |
| 50 Å depth: | 100 | 64.2 | — | 389.6 | 63.4 | 6.7 | 13.4 | — |
| Example 2 | | | | | | | | |
| Uppermost surface | 100 | — | 23.3 | 422.1 | — | 10.5 | 66.3 | 541.9 |
| 50 Å depth: | 100 | — | 10 | 185 | — | 8.8 | 9.1 | — |
| Example 3 | | | | | | | | |
| Uppermost surface | 100 | — | 29.3 | 356.6 | 53.5 | 6.1 | — | 453.5 |
| 50 Å depth: | 100 | — | 51.6 | 320.7 | 43.1 | 4.8 | — | — |

Measuring device: A 670 xi type scanning Auge electron spectroscope manufactured by ULVAC-PHI. INC.; electron probe diameter: 0.1 μm or smaller. An argon ion gun was used in etching.

TABLE 2

| | Evaluation on fog | | | Measurement potential (−V) | | | | | |
|---|---|---|---|---|---|---|---|---|---|
| | Normal temp./ normal humidity | High temp./ high humidity | Low temp./ low humidity | Normal temp./ normal humidity | | High temp./ high humidity | | Low temp./ low humidity | |
| | | | | Dark area | Light area | Dark area | Light area | Dark area | Light area |
| Example 1 | AA | AA | AA | 700 | 170 | 700 | 170 | 700 | 175 |
| Example 2 | AA | AA | AA | 705 | 170 | 700 | 170 | 705 | 180 |
| Example 3 | AA | AA | AA | 695 | 170 | 695 | 165 | 700 | 175 |
| Comparative | C | B | C | 700 | 170 | 690 | 150 | 700 | 220 |

TABLE 2-continued

| | Evaluation on fog | | | Measurement potential (−V) | | | | | |
|---|---|---|---|---|---|---|---|---|---|
| | Normal temp./ normal humidity | High temp./ high humidity | Low temp./ low humidity | Normal temp./ normal humidity | | High temp./ high humidity | | Low temp./ low humidity | |
| | | | | Dark area | Light area | Dark area | Light area | Dark area | Light area |
| Example 1 | | | | | | | | | |
| Comparative Example 2 | C | B | C | 700 | 170 | 695 | 165 | 700 | 180 |
| Comparative Example 3 | B | B | C | 700 | 170 | 695 | 160 | 705 | 180 |
| Reference Example | A | A | A | 700 | 170 | 700 | 170 | 700 | 175 |

Evaluation
AA: Exceptional
A: Excellent
B: Good
C: Poor

TABLE 3

| | Percentage of the number of atoms of each element to the number of aluminum atoms (atom %) | | | | | | | |
|---|---|---|---|---|---|---|---|---|
| Measured at: | Aluminum | Titanium | Zirconium | Oxygen | Nitrogen | Fluorine | Phosphorus | Carbon |
| Example 7 | | | | | | | | |
| Uppermost surface: | 100 | — | 59 | 232.7 | 100 | 34 | 100 | 394.7 |
| 50 Å depth: | 100 | — | 95 | 916.7 | 20.8 | 8.3 | 45.8 | — |

Measuring device: A 670 xi type scanning Auge electron spectroscope manufactured by ULVAC-PHI. INC.; electron probe diameter: 0.1 μm or smaller. An argon ion gun was used in etching.

TABLE 4

| | Evaluation on fog | | | Measurement potential (−V) | | | | | | |
|---|---|---|---|---|---|---|---|---|---|---|
| | Normal temp./ normal humidity | High temp./ high humidity | Low temp./ low humidity | Normal temp./ normal humidity | | High temp./ high humidity | | Low temp./ low humidity | | Interference Fringe |
| | | | | Dark area | Light area | Dark area | Light area | Dark area | Light area | |
| Example 7 | A | A | A | 700 | 170 | 700 | 165 | 700 | 180 | — |

Evaluation
A: Excellent

What is claimed is:

1. A process for producing an electrophotographic photosensitive member, comprising, in sequence:

a) abrading an aluminum substrate with an abrasive dispersion containing 5% by volume or more of an abrasive having a 50% diameter of from 5 μm to 60 μm as measured in cumulative percentage;

b) etching the aluminum substrate with at least one of an acid and an alkali;

c) subjecting the abraded and etched aluminum substrate to chemical conversion without anodizing with an aqueous acid solution containing a salt of titanium or a salt of zirconium; and d) forming a photosensitive layer on the aluminum substrate having been subjected to the chemical conversion.

2. A process according to claim 1, wherein the salt of titanium and the salt of zirconium are fluorine compounds.

3. A process according to claim 1, wherein said aqueous acid solution has a pH of from 1.0 to 5.5.

4. A process according to claim 1, wherein said aqueous acid solution has a temperature of from 30° C. to 90° C.

5. A process according to claim 1, wherein said aqueous acid solution further contains at least one compound selected from the group consisting of a phosphoric acid, a phosphate, a tannin and a tannic acid.

6. A process according to claim 1, wherein said aqueous acid solution further contains at least one compound selected from the group consisting of hydrofluoric acid, borofluoric acid, hydrosilicofluoric acid and a salt of any of these.

7. A process according to claim 1, wherein in the etching an acid is used.

8. A process according to claim 1 or 7, wherein in the etching sulfuric acid is used.

9. A process according to claim 1, wherein in the etching an alkali is used.

10. A process according to claim 1 or 9, wherein in the etching sodium hydroxide is used.

11. A process according to claim 1, wherein said abrasive is alumina particles.

12. A process according to claim 11, wherein said alumina particles have a bulk density of from 1.6 $g/cm^3$ to 2.3 $g/cm^3$.

13. A process according to claim 1, wherein said process has the step of cutting the aluminum substrate with a diamond bite before the step a).

* * * * *

UNITED STATES PATENT AND TRADEMARK OFFICE

CERTIFICATE OF CORRECTION

PATENT NO. : 6,432,603 B1
DATED : August 13, 2002
INVENTOR(S) : Tomohiro Kimura et al.

It is certified that error appears in the above-identified patent and that said Letters Patent is hereby corrected as shown below:

Title page,
Item [56], FOREIGN PATENT DOCUMENTS, insert -- JP 57-62056 4/1982 --..

Column 3,
Line 41, “substrate the” should read -- substrate of the --;
Line 43, “invention has.” should read -- invention. --.

Column 5,
Line 4, “relativley a” should read -- do little --;
Line 5, “little act” should be deleted;
Line 6, “more act” should read -- act more --.

Column 6,
Line 21, “a too long” should read -- too long a --.

Column 10,
Line 41, “1 ,” should read -- 1, --;
Line 42, “3 ,” should read -- 3, --;
Line 46, “3 ,” should read -- 3, --.

Column 16,
Line 38, “2 30.5” should read -- 30.5 mm --.

Signed and Sealed this

Eighth Day of April, 2003

JAMES E. ROGAN
*Director of the United States Patent and Trademark Office*